United States Patent [19]

Kageyama et al.

[11] 4,019,089

[45] Apr. 19, 1977

[54] WIDEBAND MULTI-CAVITY VELOCITY MODULATION TUBE

[75] Inventors: Takao Kageyama; Hiroshi Kato, both of Tokyo, Japan

[73] Assignee: Nippon Electric Company, Ltd., Tokyo, Japan

[22] Filed: Mar. 23, 1976

[21] Appl. No.: 669,648

[30] Foreign Application Priority Data

Apr. 3, 1975 Japan ..... 50-40627

[52] U.S. Cl. ..... 315/5.43; 315/5.39; 315/5.52

[51] Int. Cl.[2] ..... H01J 25/10

[58] Field of Search ..... 315/5.39, 5.43, 5.51, 315/5.52

[56] References Cited

UNITED STATES PATENTS

| | | | |
|---|---|---|---|
| 3,195,007 | 7/1965 | Watson et al. | 315/5.43 |
| 3,622,834 | 11/1971 | Lien | 315/5.52 |
| 3,725,721 | 4/1973 | Levin | 315/5.43 |
| 3,775,635 | 11/1973 | Faillon et al. | 315/5.43 |
| 3,819,977 | 6/1974 | Kageyama | 315/5.42 |
| 3,974,417 | 8/1976 | Kageyama et al. | 315/5.43 |

*Primary Examiner*—Saxfield Chatmon, Jr.
*Attorney, Agent, or Firm*—Ostrolenk, Faber, Gerb & Soffen

[57] ABSTRACT

A multi-cavity type velocity modulation tube, operable in the K-band above 10 GHz and having input, prebuncher, buncher and output cavities which are respectively tuned to frequencies that are higher than the upper end of the operating pass band; near the upper end of the operating pass band and lower than the resonant frequency of the input cavity; higher than the resonant frequency of the input cavity; and within the operating pass band of the tube. The input cavity Q-value is lower than that of the prebuncher cavities.

Preferably first and second prebuncher and first and second buncher cavities are provided, the second prebuncher and at least one of the bunchers are unloaded and the second prebuncher is tuned to a frequency in the vicinity of the lower end of the operating pass band.

The design yields a low cost tube having a significantly improved gain-bandwidth product.

6 Claims, 3 Drawing Figures

WIDEBAND MULTI-CAVITY VELOCITY MODULATION TUBE

BACKGROUND OF THE INVENTION

The present invention generally relates to a multi-cavity velocity modulation tube, and more particularly, to a high-gain wideband velocity modulation tube operable in the K-band higher than 10 GHz.

In a multi-cavity velocity modulation tube, a staggered tuning system is employed in which respective cavities are tuned to different frequencies in the pass band of the tube for the purpose of improving the gain versus frequency characteristics. Heretofore, in high-gain wide-band velocity modulation tubes operable in a microwave band lower than 10 GHz, in order to mitigate the variation of the cavity impedance in accordance with frequency variation, the Q-value of the cavity is lowered, and simultaneously the electron beam perveance is selected at a large value in the vicinity of $2.0 \times 10^{-6}$ A/V so that the gain may not be lowered by the reduction of the Q-value.

On the other hand, in the K-band higher than 10 GHz, since the plasma wavelength is elongated to lengthen an effective drift length because of the fact that it is difficult to manufacture an extremely small cavity, it is necessary to select the electron beam perveance at $1.0 \times 10^{-6}$ A/V or less. In addition, in the K-band, since an exciter having a high output power is not available, velocity modulation handling a high power must be carried out at a high gain. However, in order to realize a high gain with a low perveance, it is necessary to improve absorption of incident power in the input cavity by lowering the Q-value of this cavity and also to enhance the Q-values of the intermediate cavity or cavities and the output cavity. But there is a difficulty in that if these steps are carried out, then wide-band characteristics cannot be obtained, and on the contrary if the Q-values of the intermediate cavity or cavities and the output cavity were to be lowered to obtain wide-band characteristics, then the gain would be lowered.

According to one solution for such difficulty in a klystron amplifier to be used in the K-band as disclosed in U.S. Pat. No. 3,622,834, an electron beam perveance in a velocity modulation tube having a center band frequency of 12.2 GHz is selected at $0.5 \times 10^{-6}$ A/V, an input cavity is tuned to a frequency slightly lower than the center band frequency, a first prebuncher cavity is tuned to a frequency lower than the upper band edge, a second prebuncher cavity is tuned to a frequency lower than the lower band edge, two buncher cavities are tuned to a frequency higher than the first prebuncher cavity, external loads are applied to the input cavity as well as the first and second prebuncher cavities, and the two buncher cavities are kept unloaded, whereby a small-signal gain of 59 dB can be realized when a $^{-}1$ dB bandwidth is 32 MHz.

However, the velocity modulation tube constructed as described above has disadvantages that since the Q-value of the input cavity cannot be made extremely low because of the fact that the resonant frequency of the input cavity is selected to lie within the pass band of the tube, and since the effective Q-value of the buncher cavity is too low because the external load is supplied thereto despite the fact that debunching would occur in the second prebuncher cavity which is tuned to the frequency lower than the lower band edge, a sufficiently high gain and a sufficiently large bandwidth cannot be obtained; and that since hermetically sealed waveguides for connection to external circuits are mounted to the second prebuncher cavity in addition to the input cavity, the first prebuncher cavity and output cavity, the tube is accordingly of higher cost and also is inconvenient to handle.

Objects and Brief Description of the Invention

One object of the present invention is to provide a velocity modulation tube of low cost that is operable in the K-band higher than 10 GHz and that has a large gain-bandwidth product.

According to one feature of the present invention, a multi-cavity velocity modulation tube comprises an input cavity, a first prebuncher cavity, a second prebuncher cavity, one or more buncher cavities, and an output cavity for deriving an output wave energy arranged along an electron beam path, and a plurality of drift tubes disposed between said respective cavities. The input cavity is tuned to a frequency higher than the upper band edge frequency of the operating pass band of the tube, the first prebuncher cavity is tuned to a frequency lower than the resonant frequency of the input cavity and in the vicinity of the upper band edge frequency of the operating pass band, the second prebuncher cavity is tuned to a frequency in the vicinity of the lower band edge frequency of the operating pass band, the one or more buncher cavities are tuned to a frequency higher than the resonant frequency of the input cavity, and the output cavity is tuned to a frequency within the operating pass band of the tube. The Q-value of the input cavity is selected to be lower than the Q-value of the first prebuncher cavity. Also, the second prebuncher cavity and the one or more buncher cavities are unloaded.

According to the design principle of the invention, the coupling between the external waveguide circuit and the cavity is made closer by using a large coupling hole while reducing the Q-value of the input cavity and tuning the resonant frequency of the input cavity to a frequency higher than the upper band edge frequency of the operating passband of the tube, so as to enhance power gain by increasing the incident power to the input cavity. Nextly, with regard to the second prebuncher cavity that is important for realizing wideband characteristics, in view of the fact that the magnitude of the effective Q-value affecting its band pass characteristics can be lowered by the debunching effect on the electron beam, and that in a low-perveance klystron, since the Q-value depending upon the beam loading is high, the Q-value is liable to be affected and lowered by the debunching, the second prebuncher cavity is unloaded and it is tuned to a frequency in the vicinity of the lower band edge of the operating pass band. In addition, an external load is supplied to the first prebuncher cavity such that the Q-value of the first prebuncher cavity is about twice as large as the Q-value of the input cavity, and is tuned to a frequency in the vicinity of the upper band edge, the one or more buncher cavities are unloaded and tuned to a frequency higher than the resonant frequency of the input cavity, and the output cavity is tuned to about the center band frequency, whereby improvements in the band pass characteristics may be contemplated while realizing a high gain. Still further, in contrast to the known wideband multi-cavity velocity modulation tubes in the prior art, since it has become possible to keep the second prebuncher cavity unloaded, the connection to the external circuit is unnecessary, and so, the cost of the tube can be lowered by an equivalent amount.

BRIEF DESCRIPTION OF THE FIGURES

Now the invention will be described in more detail with reference to the accompanying drawings, in which.

DETAILED DESCRIPTION OF THE INVENTION

Figure 1:
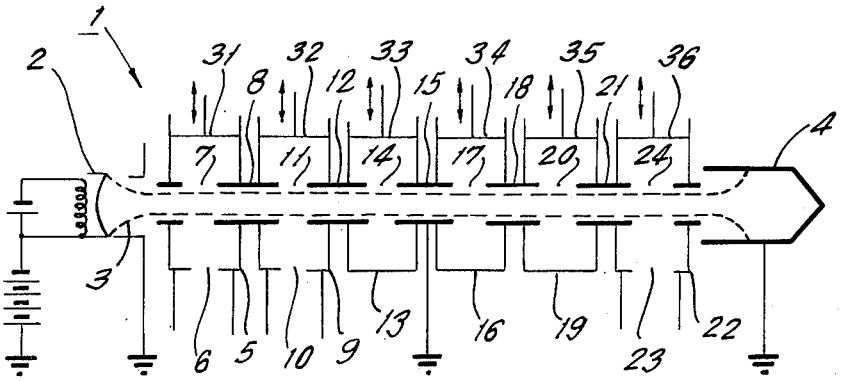
FIG. 1 is a schematic structural view showing a six-cavity velocity modulation tube according to the present invention.

Referring now to FIG. 1 of the drawings which shows one preferred embodiment of the velocity modulation tube according to the present invention, a tube 1 comprises an electron gun assembly forming an electron beam 3, and a collector electrode 4 disposed at the terminal end of the long beam path. A re-entrant cylindrical type of input cavity 5 is disposed at the upstream terminal end of the electron beam 3, and is excited by high frequency energy applied from an external circuit via an input coupling hole 6. In addition, the cavity 5 has its resonant frequency tuned to a frequency higher than the pass band of the tube by adjusting the variable tuning means associated with this cavity such as, for example, a tuning plate 31, and includes an interaction gap 7 defined by the gap between the adjacent free ends of the re-entrant cylindrical cavity, so that a high frequency voltage generated across the interaction gap 7 can velocity-modulate the electron beam 3. A first drift tube 8 surrounds the electron beam 3 in the downstream region of the input cavity 5 to form a region free from a radio frequency electromagnetic field, in which the electrons in the electron beam 3 drift at the velocities determined by the magnitude of the velocity modulation imposed by the input cavity 5, resulting in the bunching of electrons. Consequently, when the electron beam 3 passes through an interaction gap 11 in a first prebuncher cavity 9, there exists in the electron beam 3 a fundamental wave density-modulated current which is phase delayed by approximately about 90° with respect to the voltage generated across the interaction gap 7. Since the first prebuncher cavity 9 is tuned to a frequency slightly below the upper band pass edge by adjustment of variable tuning means 32, the phase of the high frequency voltage induced across the interaction gap 11 by this density-modulated current is delayed by less than 90° with respect to the phase of the voltage across the interaction gap 7 at a frequency lower than the resonant frequency, while it is delayed more than 90° at a frequency higher than the resonant frequency. Therefore, the electron beam 3 bunched within the region of the first drift tube 8 is subjected to different effects in the interaction gap 11 as bounded by the resonant frequency. More particularly, at a frequency lower than the resonant frequency, the effect of the interaction is such that the bunching may be further enhanced, whereas at a frequency higher than the resonant frequency, the effect of the interaction is such that the electron beam is once subjected to debunching. As a result, despite the fact that the resonant frequency of the first prebuncher cavity is close to the resonant frequency of the input cavity, the gain at the upper band pass edge of the operating pass band would not rise abruptly. In addition, the first prebuncher cavity 9 is provided with coupling means 10 such as a coupling hole for the purpose of adjusting the magnitude of the Q-value, and is connected to an external circuit containing a resistance element (not shown) via said coupling means.

A second prebuncher cavity 13 is tuned to a frequency slightly lower than the lower band pass edge by adjustment of variable tuning means 33, so that the phase of the high frequency voltage across an interaction gap 14 has a large delay of more than 90° with respect to the phase of the high frequency voltage across the interaction gap 11. Consequently, the electron beam 3 bunched within the region of the second drift tube 12 is subjected to debunching in the interaction gap 14, and bunching of different phase from the previous bunching would be formed within the region of the third drift tube 15.

A first buncher cavity 16 and a second buncher cavity 19 are tuned to frequencies higher than the resonant frequency of the input cavity 5 by adjustment of variable tuning means 34 and 35 respectively. Therefore, the cavity impedance varies gradually and is sufficiently inductive within the pass band so that the high frequency voltages induced across the interaction gaps 17 and 20, respectively, would act to further enhance the bunchings formed within the third drift tube 15 and the fourth drift tube 18, respectively.

Finally, an output cavity 22 has an interaction gap 24, and is tuned to a center frequency of the pass band by adjustment of variable tuning means 36. The density-modulated electron beam 3 excites the output cavity 22, and output wave energy is extracted via coupling means 23 such as a coupling hole. A fifth drift tube 21 is placed between the cavities 19 and 22 to afford a drift region that is free from a radio frequency electromagnetic field.

Figure 2:
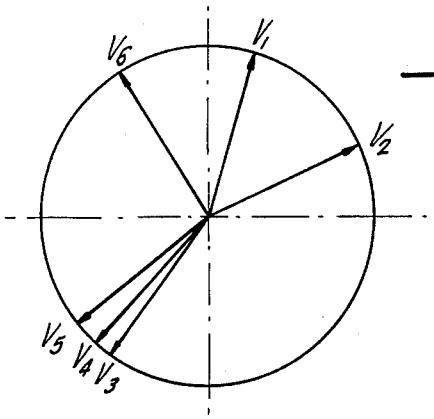
FIG. 2 is a phase diagram of the high frequency voltages generated across the interaction gaps in the respective cavities of the tube shown in FIG. 1.

FIG. 2 is a representation of the phase relationship between the gap voltage $V_1$ in the input cavity 5 taken as a reference phase and the high frequency voltages $V_2$, $V_3$, $V_4$, $V_5$ and $V_6$ generated across the interaction gaps in the subsequent respective cavities with respect to the operating frequency at the center of the pass band. More particularly, with respect to the voltage $V_1$ developed across the interaction gap 7 in the input cavity 5, the voltage $V_2$ developed across the next subsequent interaction gap 11 is approximately in phase, while the voltage $V_3$ across the interaction gap 14 is approximately in an out-of-phase relationship to the voltage $V_2$, so that the voltage $V_3$ acts upon the electron beam 3 to debunch the bunched electrons in the electron beam 3, and thereby the magnitude of the effective Q-value which affects the band characteristics is reduced. Since the voltages $V_4$ and $V_5$ generated across the interaction gaps 17 and 20, respectively, are substantially in phase with the voltage $V_3$, these voltages $V_4$ and $V_5$ act upon the electron beam 3 so as to further enhance the bunching that was velocity-modulated by the voltage $V_2$. Finally, since the voltage $V_6$ across the interaction gap 24 has a phase delayed by about 90° with respect to the voltage $V_5$, the output cavity 22 serves to decelerate the bunched electron beam 3 and extract output wave energy.

Figure 3:
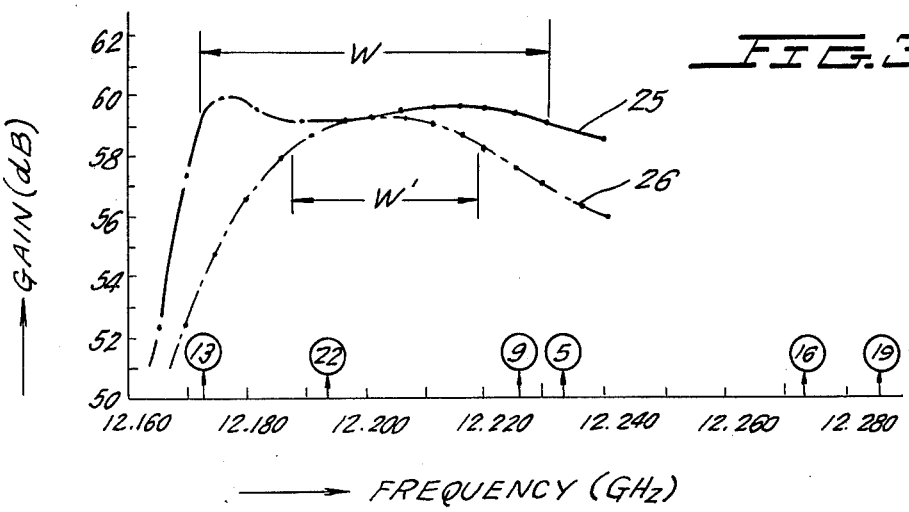
FIG. 3 is a diagram showing characteristic curves of small-signal gain (dB) versus frequency (GHZ) for comparing the tube shown in FIG. 1 with tubes according to the prior art design.

Curve 25 in FIG. 3 shows small-signal gain versus frequency characteristics of the velocity modulation tube according to the embodiment of the invention illustrated in FIG. 1. The center frequency of the pass band is 12.2 GHz, and in order to obtain the maximum gain of 60 dB and a −1 dB bandwidth (W) of 60 MHz, the respective cavities shown in FIG. 1 are tuned to the frequencies indicated by arrows numbered with the same reference numerals as those indicated in FIG. 1. On the other hand, curve 26 shows gain versus frequency characteristics of velocity modulation tubes in the prior art, in which the bandwidth (W′) is equal to 32 MHz. Therefore, it has been proved that the gain-bandwidth product is improved by a factor of about 2 according to the present invention.

For reference, a listing of typical design parameters for the tube illustrated in FIG. 1 is shown below in Table I.

TABLE I

| (Summary of Design Parameters) | |
|---|---|
| Center band frequency | 12.2 GHz |
| Beam voltage | 12.1 KV |
| Beam perveance | $0.5 \times 10^{-6}$ A/V$^{3/2}$ |
| Q under externally loaded condition | |
| Input cavity | 120 |
| First prebuncher cavity | 220 |
| Output cavity | 220 |
| with the other cavities being unloaded | |
| Resonant frequencies | |
| Input cavity | 12.233 GHz |
| First prebuncher cavity | 12.226 GHz |
| Second prebuncher cavity | 12.172 GHz |
| First buncher cavity | 12.273 GHz |
| Second buncher cavity | 12.285 GHz |
| Output cavity | 12.194 GHz |

While the invention has been described above in connection with a six-cavity velocity modulation tube, the high-gain wideband characteristics can be obtained exactly in the same manner for a velocity modulation tube having five or more cavities, as long as the resonant frequencies of one or more buncher cavities are each tuned to frequencies higher than the resonant frequency of the input cavity.

Furthermore, the resonator circuits which may be used according to the present invention are not limited to the re-entrant type cylindrical cavities, but may be formed of distributed-electric-field-type helical resonators.

What is claimed is:

1. A multi-cavity velocity modulation tube having a collector electrode and an electron gun assembly for directing an electron beam towards said collector, said tube having an operating pass band of a predetermined frequency bandwidth, characterized in that said tube further comprises an input cavity tuned to a frequency higher than the upper band edge frequency of said operating pass band, a first prebuncher cavity disposed downstream of the input cavity along the electron beam path and tuned to a frequency lower than the resonant frequency of the input cavity and in the vicinity of said upper band pass edge frequency of the operating pass band, a second prebuncher cavity tuned to a frequency in the vicinity of the lower band pass edge frequency of said operating pass band, at least one buncher cavity disposed downstream of said second prebuncher cavity along the electron beam path and tuned to a frequency higher than the resonant frequency of said input cavity, an output cavity disposed downstream of said buncher cavity along the electron beam path and tuned to a frequency within said operating pass band for extracting output wave energy from a density-modulated electron beam, and drift tubes intervening between every adjacent pair of said cavities; the Q-value of said input cavity being lower than the Q-value of the first prebuncher cavity; and the second prebuncher cavity and all the buncher cavities are unloaded.

2. A multi-cavity velocity modulation tube as claimed in claim 1, wherein said respective cavities are provided with variable tuning means.

3. A multi-cavity velocity modulation tube as claimed in claim 2, wherein said input cavity, said first prebuncher cavity and said output cavity are each provided with coupling means for electromagnetically coupling said cavity to an external circuit.

4. A multi-cavity velocity modulation tube as claimed in claim 3, wherein at least two buncher cavities are provided, the respective resonant frequencies of the buncher cavities are selected to be adjusted to successively higher frequencies as advanced towards the downstream along the electron beam path.

5. A multi-cavity velocity modulation tube as claimed in claim 4, wherein said buncher cavities comprise a first buncher cavity and a second buncher cavity.

6. A multi-cavity velocity modulation tube as claimed in claim 4 wherein the resonant frequency of said output cavity is tuned to a frequency lower than the center frequency of said operating pass band of the tube.

* * * * *